US005730467A

United States Patent [19]

Huang

[11] Patent Number: 5,730,467

[45] Date of Patent: Mar. 24, 1998

[54] ROLLER SKATE DEVICE

[76] Inventor: Yu-Lin Huang, 56, Min Sheng Street, Fengyuan, Taichung, Taiwan

[21] Appl. No.: 826,774

[22] Filed: Apr. 7, 1997

[51] Int. Cl.[6] ..... A63C 17/24

[52] U.S. Cl. ..... 280/843; 280/11.2; 280/11.22; 280/11.28

[58] Field of Search ..... 280/11.2, 843, 280/11.22, 11.23, 11.27, 11.28; 188/5, 6

[56] References Cited

U.S. PATENT DOCUMENTS

| | | | |
|---|---|---|---|
| 4,598,918 | 7/1986 | Rodriguez | 280/843 |
| 5,409,265 | 4/1995 | Douglass | 280/843 |
| 5,549,331 | 8/1996 | Yun et al. | 280/843 |

*Primary Examiner*—Richard M. Camby

[57] ABSTRACT

A roller skate device has a sole plate, a toe box, a heel, and a plurality of outer sleeves. The sole plate has a frame and a plate seat. Each outer sleeve receives a cylinder seat. A separating disk is disposed in a middle portion of the cylinder seat. A cushion, a ball bearing casing, a ball bearing, a hollow ball bearing cover, a nut, a dustproof plate, and a buffer packing ring are inserted in an upper interior of the cylinder seat in order. A washer, a pin bearing casing, a pin bearing, a hollow cover, a retaining ring, a dustproof ring, and a hollow pad are inserted in a lower interior of the cylinder seat in order. A hollow drive bowl is disposed beneath the hollow pad. The hollow drive bowl has a first and a second oval holes. A spherical wheel has an axle. The axle is inserted in the first and the second oval holes. A swift shaft passes through the hollow drive bowl, the dustproof ring, the retaining ring, the hollow cover, the pin bearing casing, the washer, the separating disk, the cushion, the ball bearing casing, the ball bearing, and the hollow ball bearing cover and is fastened by the nut.

2 Claims, 9 Drawing Sheets

ROLLER SKATE DEVICE

BACKGROUND OF THE INVENTION

This invention relates to a roller skate device, and more particularly, this invention relates to a roller skate device which can be operated smoothly.

A traditional roller skate can be moved linearly. However, the traditional roller skate cannot be rotated freely.

SUMMARY OF THE INVENTION

An object of this invention is to provide a roller skate device which can be rotated freely.

Another object of this invention is to provide a roller skate device which can be operated smoothly.

DETAILED DESCRIPTION OF THE INVENTION

Figure 1:
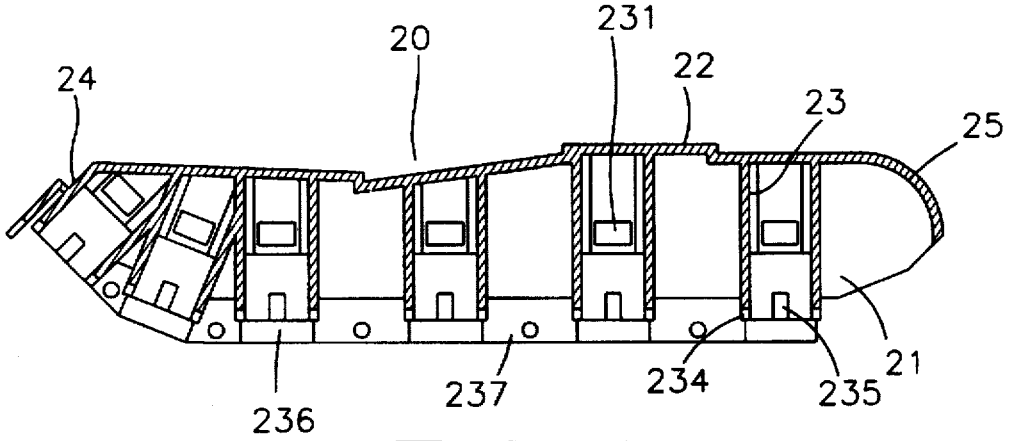
FIG. 1 is a sectional view of a sole plate.
Figure 2:
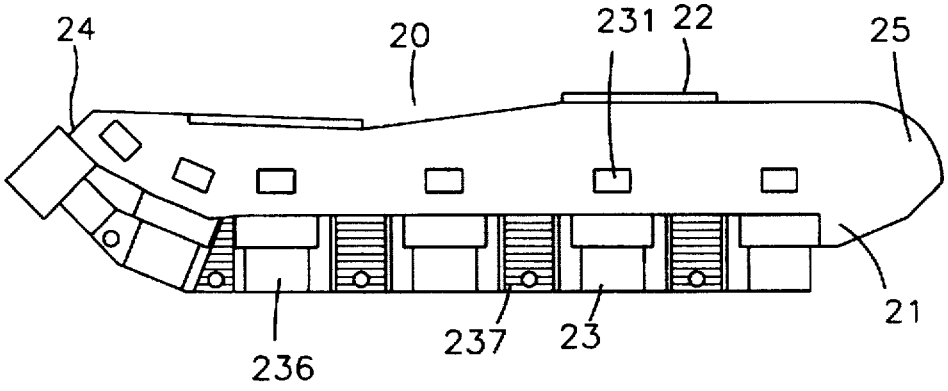
FIG. 2 is an elevational view of a sole plate.
Figure 3:
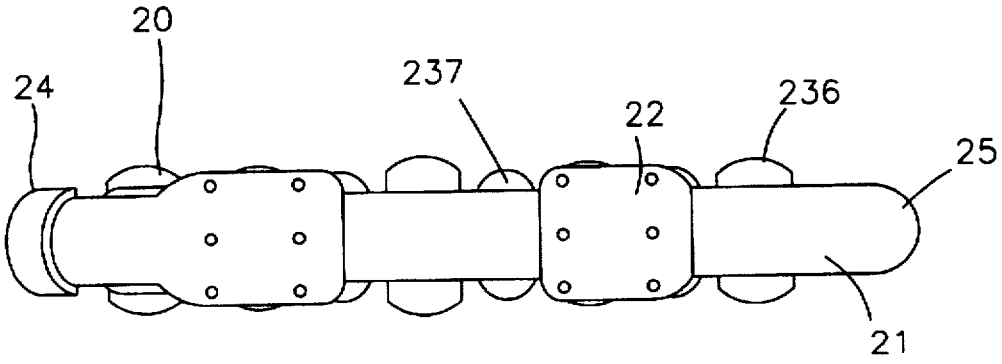
FIG. 3 is a top plan view of a sole plate.
Figure 4:
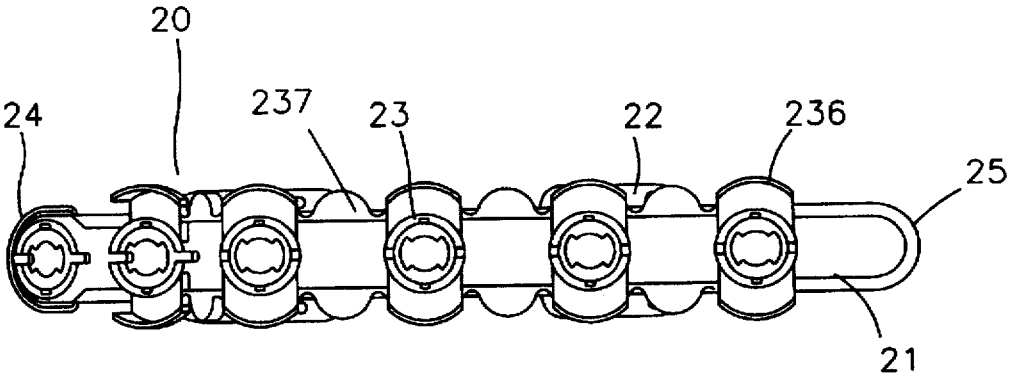
FIG. 4 is a bottom plan view of a sole plate.
Figure 5:
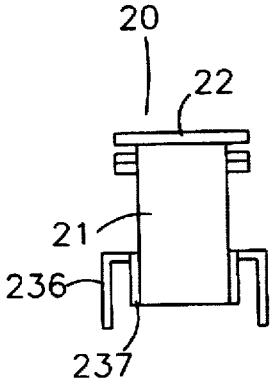
FIG. 5 is another elevational view of a sole plate.
Figure 6:
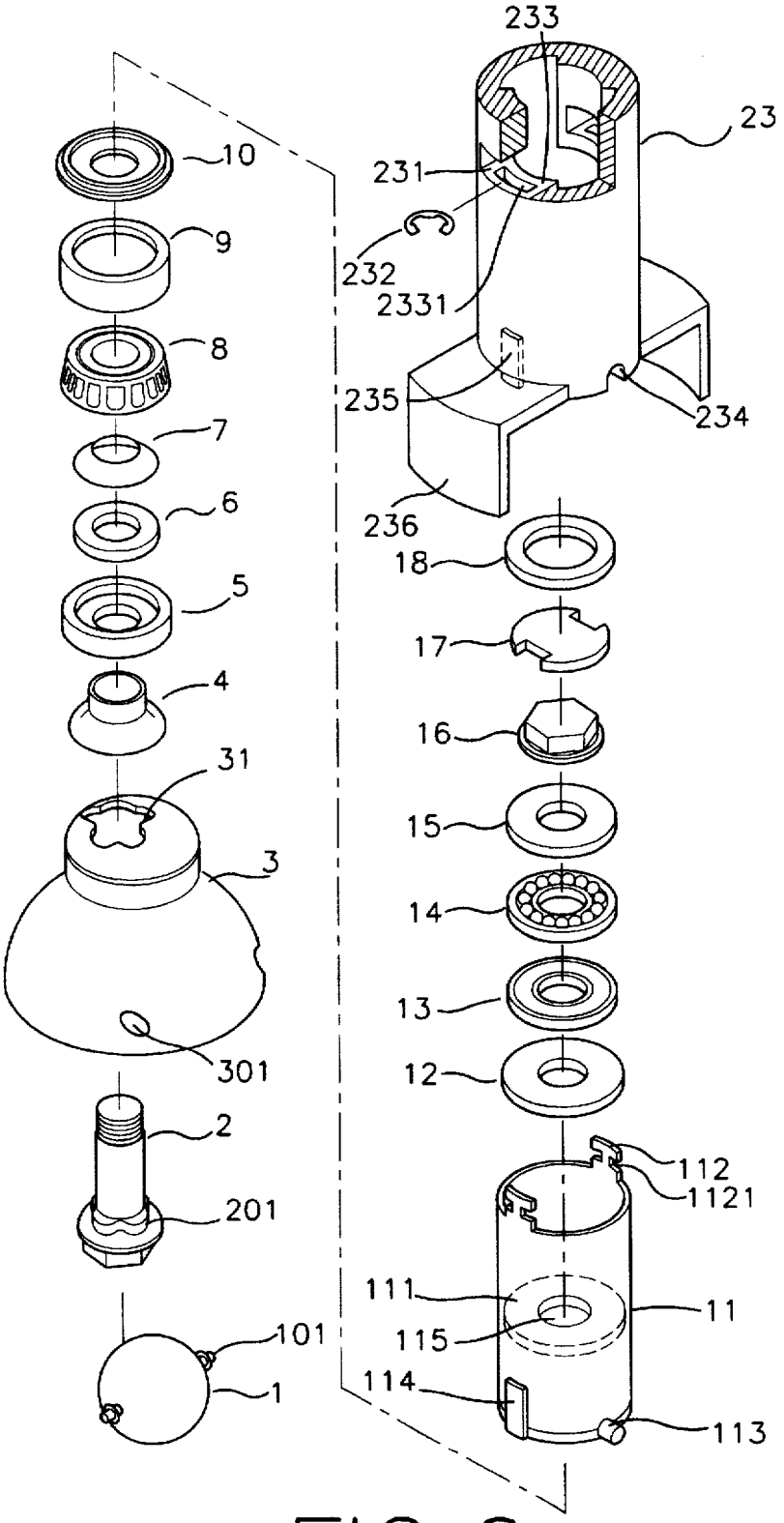
FIG. 6 is a partially perspective exploded view of an outer sleeve, a spherical wheel and a wheel support.
Figure 7:
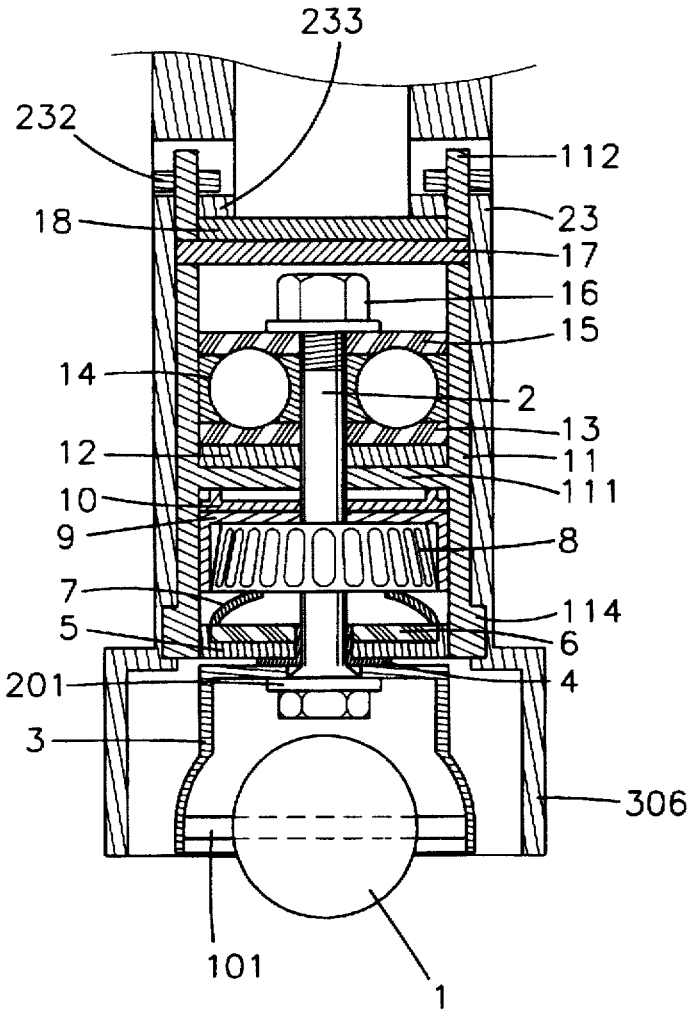
FIG. 7 is a sectional view of FIG. 6.
Figure 8:
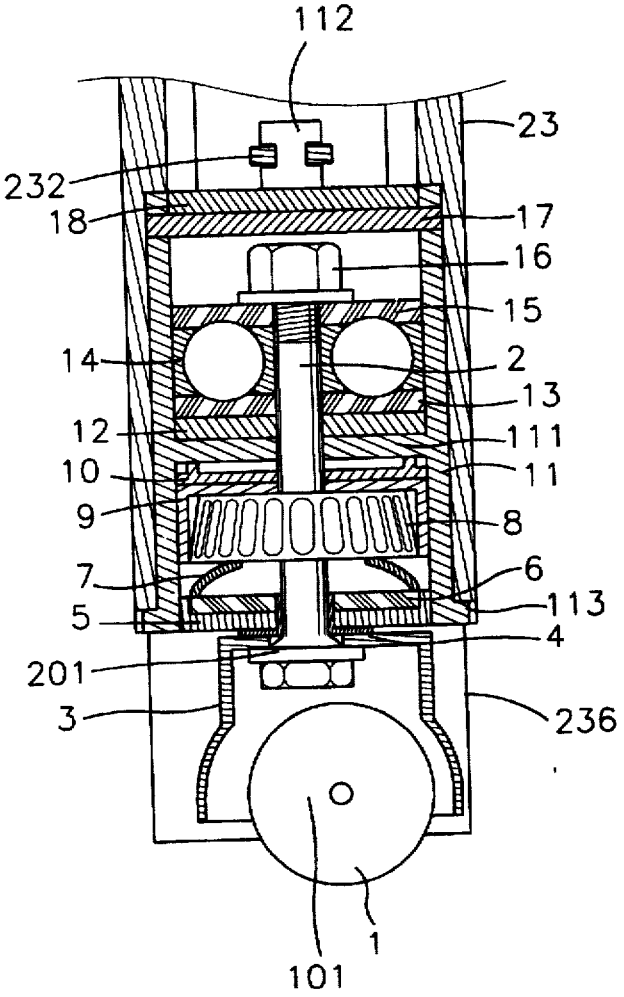
FIG. 8 is another sectional view of FIG. 6.
Figure 9:
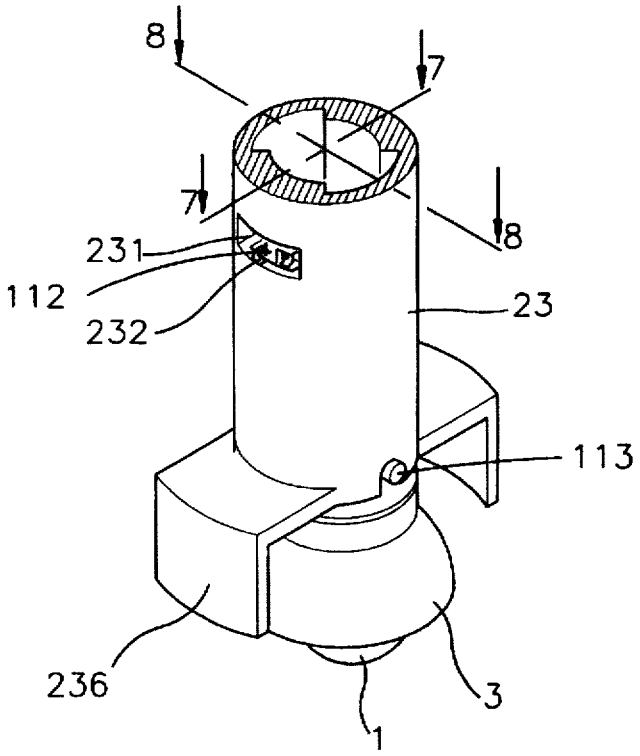
FIG. 9 is a perspective assembly view of FIG. 6.

Referring to FIGS. 1 to 9 and 11, a roller skate device comprises a sole plate 20, a toe box 24, a heel 25, and a plurality of outer sleeves 23. The sole plate 20 has a frame 21 and a plate seat 22. Each of the outer sleeves 23 receives a cylinder seat 11. A separating disk 111 is disposed in a middle portion of the cylinder seat 11. A first and a second protruded lugs 112 are extended upward from the cylinder seat 11. The first protruded lug 112 has a first positioning recess 1121. The second protruded lug 112 has a second positioning recess 1121. A first and a second protruded posts 113 are disposed on a lower end of the cylinder seat 11. A first and a second protruded blocks 114 are disposed on the lower end of the cylinder seat 11. A center hole 115 is formed on the separating disk 111. A cushion 12, a ball bearing casing 13, a ball bearing 14, a hollow ball bearing cover 15, a nut 16, a dustproof plate 17, and a buffer packing ring 18 are inserted in an upper interior of the cylinder seat 11 in order and the cushion 12 is disposed on the separating disk 111. A washer 10, a pin bearing casing 9, a pin bearing 8, a hollow cover 7, a retaining ring 6, a dustproof ring 5, and a hollow pad 4 are inserted in a lower interior of the cylinder seat 11 in order and the washer 10 is disposed on the separating disk 111. A hollow drive bowl 3 is disposed beneath the hollow pad 4. The hollow drive bowl 3 has an inner wall 31 and a first and a second oval holes 301. A spherical wheel 1 has an axle 101. The axle 101 has a first and a second ends inserted in the first and the second oval holes 301 respectively. A swift shaft 2 has a protruded periphery embossment 201. The swift shaft 2 passes through the hollow drive bowl 3, the dustproof ring 5, the retaining ring 6, the hollow cover 7, the pin bearing casing 9, the washer 10, the separating disk 111, the cushion 12, the ball bearing casing 13, the ball bearing 14, and the hollow ball bearing cover 15 and is fastened by the nut 16. Each of the outer sleeve 23 has a protecting seat 236, a first and a second slots 234, a first and a second grooves 235 to receive the corresponding first and second protruded blocks 114 respectively, and a first and a second rib plates 233. The first rib plate 233 has a first inserted hole 2331. The second rib plate 233 has a second inserted hole 2331. A first and a second notches 231 are formed on the outer sleeve 23. The first and the second protruded lugs 112 pass through the corresponding first and second inserted holes 2331 respectively. A C-shaped clamp 232 retains the first and the second protruded lugs 112. A buffer packing ring 18 is disposed between the rib plates 233 and a dustproof plate 17. The dustproof plate 17 is disposed on the nut 16. The first and the second protruded posts 113 are inserted in the corresponding first and second slots 234 respectively.

Figure 10:
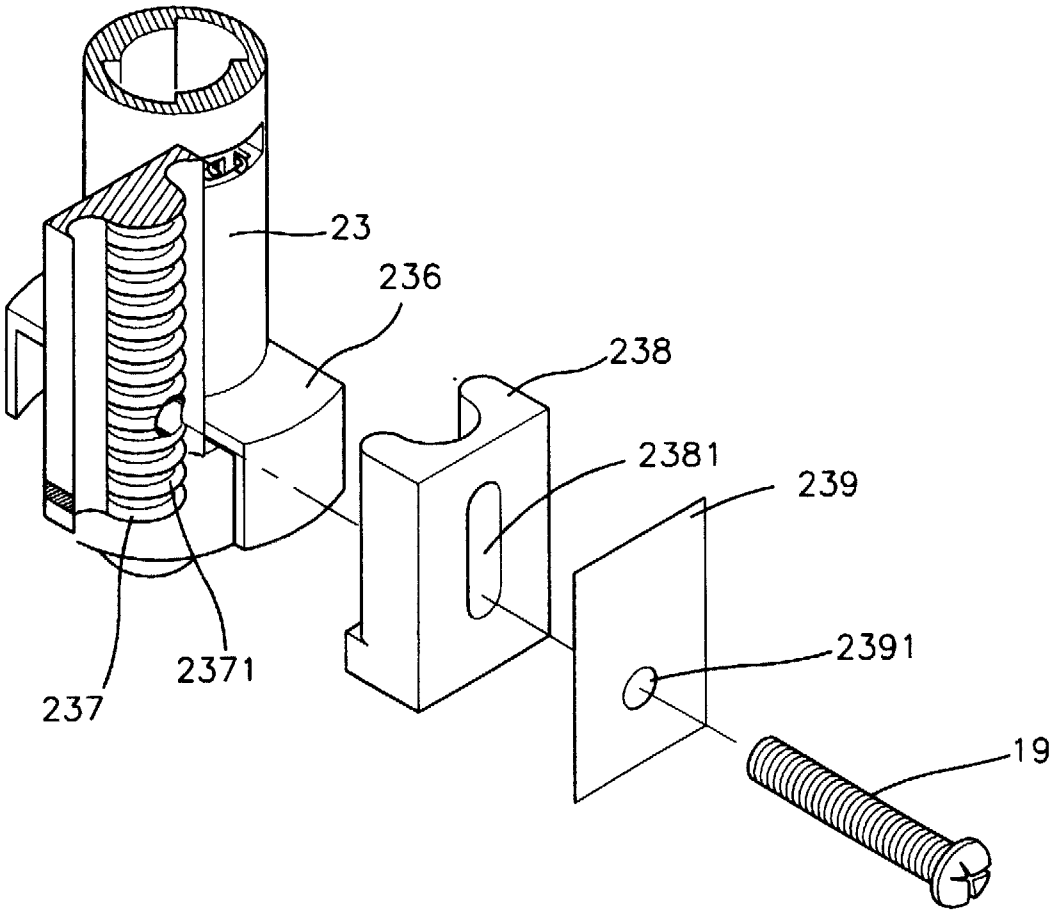
FIG. 10 is a schematic view illustrating a connection of an outer sleeve and a brake device.
Figure 11:
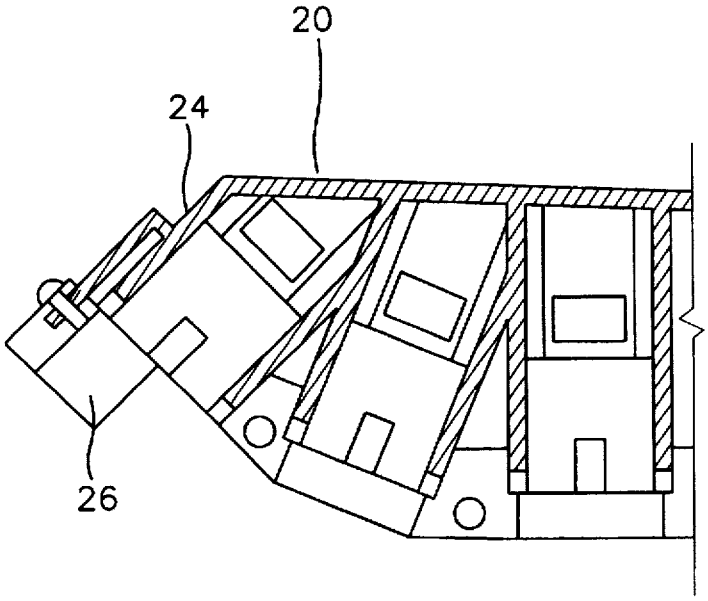
FIG. 11 is a schematic view illustrating a toe stop disposed on a sole plate.
Figure 12:
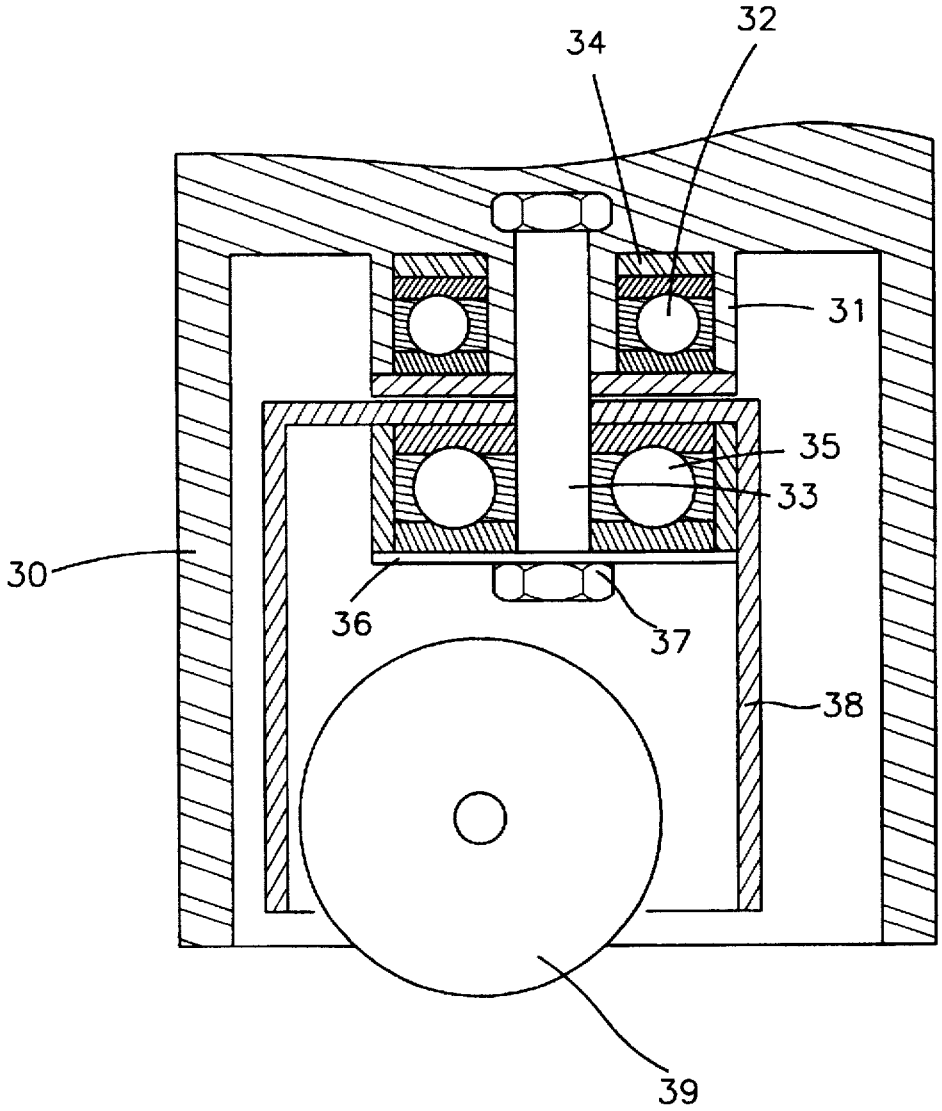
FIG. 12 is a sectional view of another preferred embodiment of this invention.

Referring to FIG. 10, a brake seat 237 is disposed on the outer sleeve 23. A threaded hole 2371 is formed on the brake seat 237. A brake plate 238 covers the brake seat 237. An oblong hole 2381 is formed on the brake plate 238. A press plate 239 is disposed on the brake plate 238. A circular hole 2391 is formed on the press plate 239. A bolt 19 passes through the circular hole 2391, the oblong hole 2381 and the threaded hole 2371 to fasten the press plate 239 and the brake plate 238 on the brake seat 237. Referring to FIG. 11, a toe stop 26 is disposed on the toe box Referring to FIG. 12, another outer sleeve 30 receives a drive sleeve 38. The outer sleeve 30 has an inner wall 31 to confine a small bearing 32 and a washer 34. A pivot rod 33 fastens the drive sleeve 38 and the outer sleeve 30. A steel cushion 36 is disposed on a lower end of the pivot rod 33 and fastened by a nut 37. A large bearing 35 is disposed in the drive sleeve 38. A round wheel 39 is connected to the drive sleeve 38.

I claim:

1. A roller skate device comprises:

a sole plate, a toe box, a heel, and a plurality of outer sleeves, the sole plate having a frame and a plate seat, each of the outer sleeves receiving a cylinder seat, a separating disk disposed in a middle portion of the cylinder seat, a first and a second protruded lugs extended upward from the cylinder seat, the first protruded lug having a first positioning recess, the second protruded lug having a second positioning recess, a first and a second protruded posts disposed on a lower end of the cylinder seat, a first and a second protruded blocks disposed on the lower end of the cylinder seat, a center hole formed on the separating disk, a cushion, a ball bearing casing, a ball bearing, a hollow ball bearing cover, a nut, a dustproof plate, and a buffer packing ring inserted in an upper interior of the cylinder seat in order and the cushion disposed on the separating disk, a washer, a pin bearing casing, a pin bearing, a hollow cover, a retaining ring, a dustproof ring, and a hollow pad inserted in a lower interior of the cylinder seat in order and the washer disposed on the separating disk, a hollow drive bowl disposed beneath the hollow pad, the hollow drive bowl having an inner wall and a first and a second oval holes, a spherical wheel having an axle, the axle having a first and a second ends inserted in the first and the second oval holes respectively, a swift shaft having a protruded periphery embossment, the swift shaft passing through the hollow drive bowl, the dustproof ring, the retaining ring, the hollow cover, the pin bearing casing, the washer, the separating disk, the cushion, the ball bearing casing, the ball bearing, and the hollow ball bearing cover and fastened by the nut, the first and the second protruded posts inserted in the corresponding first and second slots respectively, each of the outer sleeve having a protecting seat, a first and second slots, a first and a second grooves to receive the corresponding first and second protruded blocks respectively, and a first and a second rib plates, the first rib plate having a first inserted hole, the second rib plate having a second inserted hole, a first and a second notches formed on the outer sleeve, the first and the second protruded lugs passing through the corresponding first and second inserted holes respectively, a C-shaped clamp retaining the first and the second protruded lugs, a buffer packing ring disposed between the rib plates and a dustproof plate, and the dustproof plate disposed on the nut.

2. A roller skate device as claimed in claim 1, wherein a brake seat is disposed on the outer sleeve, a threaded hole is formed on the brake seat, a brake plate covers the brake seat, an oblong hole is formed on the brake plate, a press plate is disposed on the brake plate, a circular hole is formed on the press plate, and a bolt passes through the circular hole, the oblong hole and the threaded hole to fasten the press plate and the brake plate on the brake seat.

* * * * *